US010414542B2

(12) United States Patent
Schrader et al.

(10) Patent No.: US 10,414,542 B2
(45) Date of Patent: Sep. 17, 2019

(54) CONCAVE-PALLET DESIGN WITH A LIP

(71) Applicant: Walmart Apollo, LLC, Bentonville, AR (US)

(72) Inventors: Jacob R. Schrader, Sterling, IL (US); Timothy J. Burleson, Bentonville, AR (US); John S. Meredith, Bentonville, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 0 days.

(21) Appl. No.: 16/115,032

(22) Filed: Aug. 28, 2018

(65) Prior Publication Data

US 2019/0061998 A1 Feb. 28, 2019

Related U.S. Application Data

(60) Provisional application No. 62/551,446, filed on Aug. 29, 2017.

(51) Int. Cl.
*B65D 19/00* (2006.01)
*B65D 19/44* (2006.01)

(52) U.S. Cl.
CPC ..... *B65D 19/0034* (2013.01); *B65D 19/44* (2013.01); *B65D 2519/00024* (2013.01); *B65D 2519/00029* (2013.01); *B65D 2519/00034* (2013.01); *B65D 2519/00059* (2013.01); *B65D 2519/00064* (2013.01); *B65D 2519/00069* (2013.01); *B65D 2519/0096* (2013.01); *B65D 2519/00268* (2013.01); *B65D 2519/00288* (2013.01); *B65D 2519/00318* (2013.01); *B65D 2519/00815* (2013.01)

(58) Field of Classification Search
CPC ..... B65D 19/44; B65D 19/00; B65D 2519/000935; B65D 2519/0094; B65D 2519/0096; B65D 2519/00935
USPC .... 108/51.11, 57.25, 57.26, 53.1, 53.3, 55.1, 108/55.3
See application file for complete search history.

(56) References Cited

U.S. PATENT DOCUMENTS 3,228,358 A 1/1966 Sepe et al.
3,269,336 A * 8/1966 Naylor ..... B65D 19/0012 108/55.1
3,521,777 A * 7/1970 Vik ..... B65D 19/44 108/53.1

(Continued)

FOREIGN PATENT DOCUMENTS

EP 0491965 A1 7/1992

OTHER PUBLICATIONS

Stratis Roll Pallet, Stratis a Brand of Snyder Industries, Inc., Part No. RP3254S00-2SRRS, 2015.

(Continued)

*Primary Examiner* — Jose V Chen
(74) *Attorney, Agent, or Firm* — McCarter & English, LLP; David R. Burns

(57) ABSTRACT

A concave pallet with an inwardly sloping surface and lip is disclosed. The concave pallet includes a plurality of inwardly sloping surfaces meeting a surface plane equidistantly from the center point of the pallet. A lip encompasses the perimeter of the pallet and secures packages on the pallet. The lip interlocks with the bases of alike pallets for efficient stacking and storage when not in use for package shipment.

17 Claims, 5 Drawing Sheets

(56) References Cited

U.S. PATENT DOCUMENTS 3,638,586 A * 2/1972 Elshout ..... B65D 19/0012 108/57.28
3,667,403 A * 6/1972 Angelbeck, Jr. ... B65D 19/0012 108/57.26
3,776,435 A 12/1973 Smith
4,029,023 A 6/1977 Rosewicz et al.
4,060,037 A * 11/1977 Gustafsson ..... B65D 19/0024 108/55.1
4,220,100 A 9/1980 Palomo et al.
4,263,855 A * 4/1981 Lawlor ..... B65D 19/004 108/53.3
4,292,899 A * 10/1981 Steffen ..... B65D 19/0095 108/51.11
4,292,901 A 10/1981 Cox
5,076,175 A * 12/1991 Whatley, II ..... B65D 19/38 108/51.11
5,269,414 A 12/1993 D'Hollander
5,476,048 A * 12/1995 Yamashita ..... B65D 19/0012 108/51.11
5,606,921 A 3/1997 Elder et al.
5,673,629 A * 10/1997 Ginnow ..... B65D 19/0095 108/56.1
5,687,652 A * 11/1997 Ruma ..... B65D 19/0012 108/57.25
5,769,003 A 6/1998 Rose et al.
6,289,823 B1 9/2001 Koefelda et al.
6,386,118 B1 * 5/2002 Bendit ..... B65D 19/0016 108/57.25
6,718,887 B1 * 4/2004 Cook, Sr. ..... B65D 19/38 108/53.1
6,807,911 B2 * 10/2004 Carson ..... B65D 19/0018 108/57.28
7,819,068 B2 * 10/2010 Apps ..... B65D 19/004 108/53.1
8,082,858 B2 * 12/2011 Yoshizawa ..... B65D 85/48 108/53.1
8,196,527 B2 * 6/2012 Linares ..... B65D 19/0038 108/51.3
9,487,328 B2 * 11/2016 Edwards ..... B65D 19/0095
2013/0136573 A1 5/2013 Berry et al.

OTHER PUBLICATIONS

32" x 54" Roll Pallet w/ Fork Safety Straps, Synder Industries, Inc., SKU: RP3254S00-2DRRS, last viewed Apr. 24, 2017.
Rotationally Molded—Roll Pallets, Bayhead Products Corporation, http://bayheadproducts.com/shop/pallets/rotationallymoldedrollpallets/, 2017.
XIN V—Pallet—7808, Stowers Plastics, http://www.plastic.co.nz/plasticproducts/ 7808.html, last viewed Apr. 24, 2017.
Plastic Pallets, Sangam Plastic Industries Pvt. Ltd Delhi, http://www.sangamplastic.co.in/plasticpallets.html#antiskidpallets, last viewed Apr. 24, 2017.
International Search Report and Written Opinion from related International Patent Application No. PCT/US18/048323 dated Dec. 18, 2018.

* cited by examiner

CONCAVE-PALLET DESIGN WITH A LIP

CROSS-REFERENCE TO RELATED PATENT APPLICATION

This application claims priority to U.S. Provisional Application 62/551,446 filed on Aug. 29, 2017, the content of which is hereby incorporated by reference in its entirety

BACKGROUND

Pallets serve the transport of goods in commerce, and provide support for various product buildouts for ease of loading and forklift manipulation.

BRIEF DESCRIPTION OF DRAWINGS

Illustrative embodiments are shown by way of example in the accompanying drawings and should not be considered as a limitation of the present disclosure.

DETAILED DESCRIPTION

Described in detail herein are pallets having concave upper surfaces with a lip extending about a perimeter of the upper surfaces. Exemplary embodiments of the pallets facilitate a more stable pallet product build by creating an inward pressure by utilizing non-level inward sloping surfaces of embodiments of the pallets to direct package instability toward the center of a pallet and thereby act as supporting structure for the packages on the pallet. Exemplary embodiments of the pallets can be stacked to provide more efficient usage of space when the pallets are empty. The lip of the pallets can provide an interlocking mechanism between adjacent pallets in the stack where a bottom of one pallet can rest upon at least a portion of the upper surface of another pallet to nest within the perimeter of the lip protruding from the other pallet.

Figure 1A:
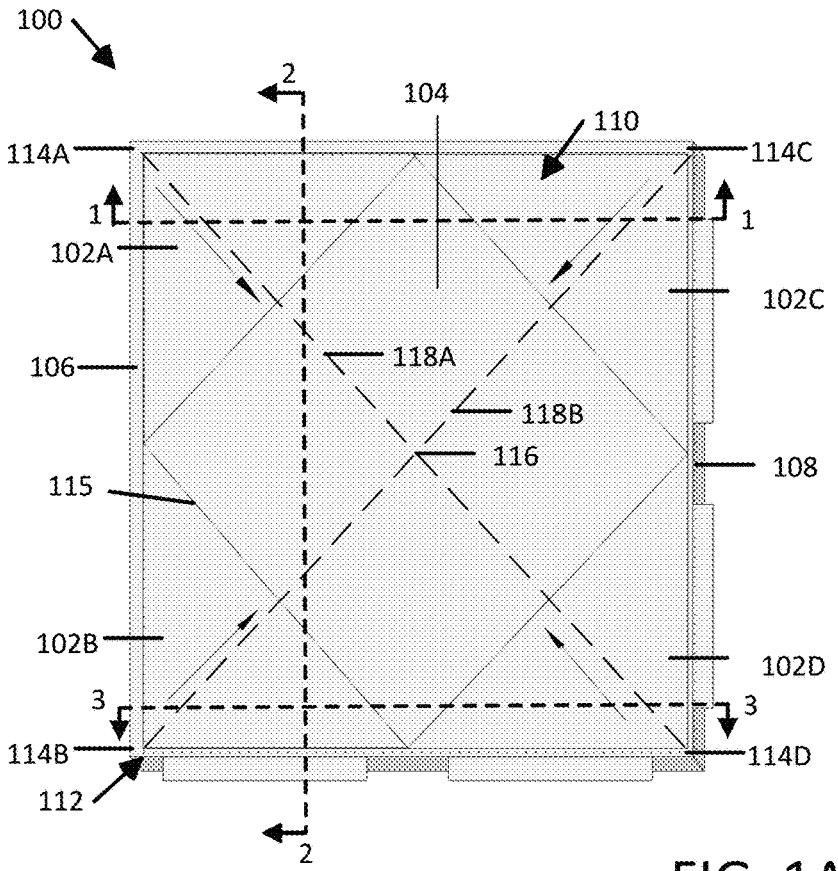
FIGS. 1A and 1B are top-view diagrams illustrating a concave pallet according to embodiments of the present disclosure.
Figure 1B:
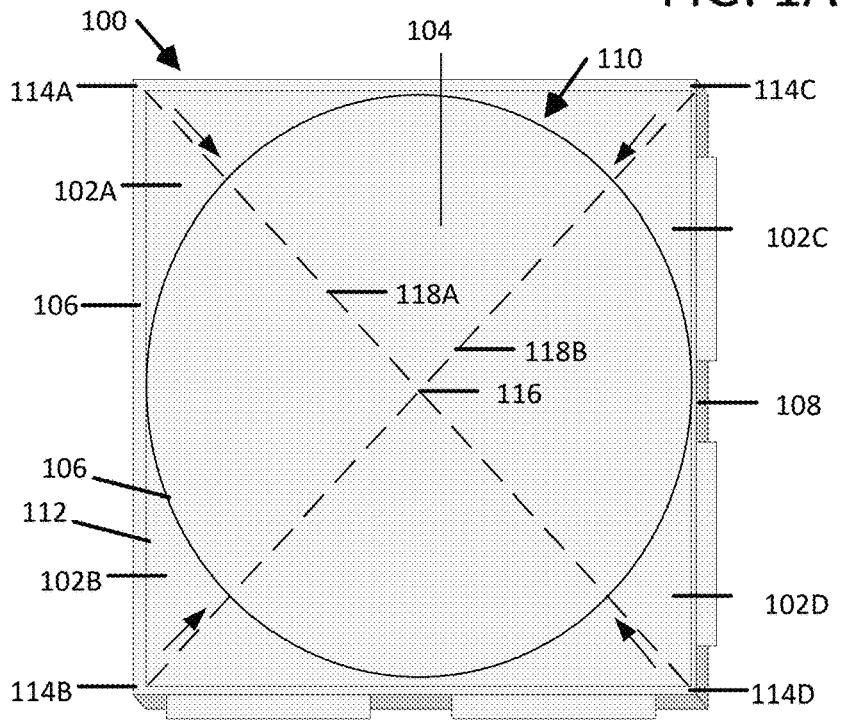

FIGS. 1A and 1B are a top-view of a pallet 100 according to one embodiment. The pallet can include a concave upper surface 110 having inward sloping portions 102A, 102B, 102C, 102D and a planar portion 104. The pallet 100 can also include a base 108 and a lip 106. The inward sloping portions 102A, 102B, 102C and the planar portion 104 are attached to the base 108. The upper surface 110 can have a rectangular perimeter 112

The inward sloping portions 102A, 102B, 102C, 102D of the upper surface 110 can originate at corners 114A, 114B, 114C, 114D of the perimeter 112 and slope downward toward the center of the pallet such that highest points on the upper surface 110 of the pallet corresponds to the corners 114A, 114B, 114C, 114D of the perimeter 112 and reside in a common/first plane. The downward slope of the inward sloping portions 102A, 102B, 102C, 102D creates a negative gradient between the corners 114A, 114B, 114C, 114D and the planar portion 104. The inward sloped portions 102A-D extend from the corners 114A-D, respectively, to the planar portion 104 at an acute angle relative to the common/first plane to define the gradient between the perimeter 112 and the surface, where each of the inward sloped portions coincide with a separate and distinct independent plane that intersects the first/common plane and a second plane within which the planar portion 104 resides. The lip 106 extends from and about the perimeter 112 of the upper surface 110 on a second side of the common/first plane, i.e. on the side opposite the inward sloped portions 102A-D.

In the present embodiment, the negative gradient of the inward sloping portions 102A, 102B, 102C, 102D can be linear such that each of the sloping portions 102A, 102B, 102C, 102D reside in separate and distinct planes that intersect the common plane and a plane coinciding with the planar portion 104. The gradient can decrease to zero at a transition between the inwardly sloping portions 102A, 102B, 102C, 102D and the planar portion 104 corresponding to a slope of zero. In some embodiments, the gradient of the inward sloping surfaces 102A, 102B, 102C, 102D may be non-linear, e.g., the inward sloping portions 102A, 102B, 102C, 102D of the upper surface can have a curvature.

The planar portion 104 can have a rectangular perimeter 115 corresponding to the transition between the inwardly sloping portions 102A, 102B, 102C, 102D and the planar portion 104. The planar portion 104 is disposed inward and spaced away from the perimeter 112. The rectangular perimeter 115 of the planar portion 104 can be offset or rotated approximately forty-five (45) degrees relative to the perimeter 112 of the upper surface 110. Alternatively, in some embodiments, the perimeter 115 of the planar portion 104 can be circular in geometry (i.e. a circumference) as shown in FIG. 1B, while the perimeter 112 of the upper surface 110 is non-circular (e.g., rectangular).

The upper surface 110 of the pallet can be utilized for the support of products (e.g., boxes or crates) placed on the pallet 100. When the products are placed on the upper surface, the inward sloping surfaces 102A, 102B, 102C, 102D create inward tilt on the products such that the products tilt inwardly towards a center 116 of the pallet 100, e.g., defined by an intersection of lines 118A, 118B between opposing corners of the perimeter 112. The inward tilt creates a pressure in all directions corresponding to the corners of the pallet. When products are properly placed on the inward sloping surfaces 102A, 102B, 102C, 102D, the pressure created by the inward tilt holds the products in place toward the center 116 of the upper surface 110. Proper placement of the packages can include stacking like-sized and like-weighted products at approximately the same level on the pallet. For example, heavier like-sized products should be placed equally directly on the inward sloping surfaces 102A, 102B, 102C, 102D. Lighter like-sized products should be placed on the heavier like-sized products.

The lip 106 traverses the perimeter 112 of the upper surface 110 of the pallet 100. The lip 106 can protrude from the sides of the pallet 100, or can be flush with the sides of the pallet 100. For embodiments in which the lip 106 is flush with the sides of the pallet, the base 108 of the pallet may be notched as shown in FIG. 2C, to allow the insertion of another pallet's base 108 into the area interior to the lip 106 of the pallet. For embodiments in which the lip 106 protrudes from the sides of the pallet, the base 108 of the pallet may not include a notch such that the base 108 can fit into the area interior to the lip 106. In some embodiments, the lip 106 may be notched on the interior wall or include a jog to allow the insertion of another pallet's base 108 into the area interior to the lip 106.

The pallet 100 can be from one or more materials suitable for supporting the weight and facilitating the transport of products. Examples of suitable materials can include wood, polymers, or metals. Metal strike plates may be affixed to the base 108 to reinforce corners, increasing durability, and usable life of the pallet. The base 108 may include channels for supporting forklift usage. Alternatively, the base 108 can include cavities for material savings and weight reduction. The base may be manufactured in traditional pallet building processes, however less conventional approaches, such as three dimensional (3D) printing may be employed. 3D printing may allow for material savings as 3D printing allows for the creation of geometries previously not available with traditional injection mold manufacturing.

Figure 2A:
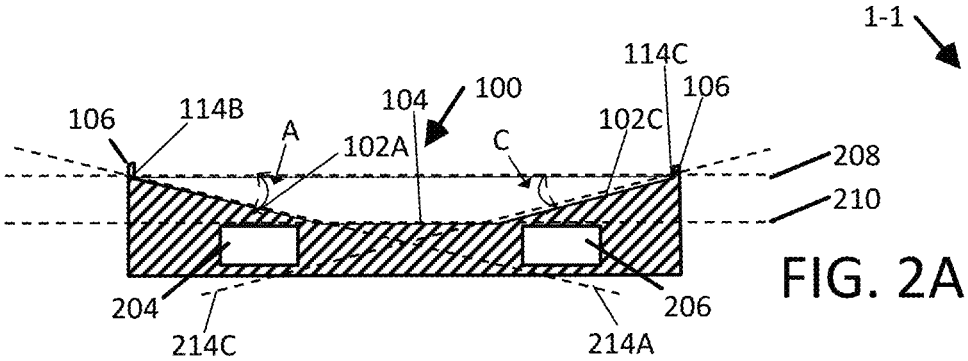
FIG. 2A is a cross sectional side view of a concave pallet according to embodiments of the present disclosure.

FIG. 2A is a cross sectional view of an embodiment of the pallet 100 along line 1-1 shown in FIG. 1A through the inward sloped portions 102A and 102C, as well as voided channels 204, 206 through the base 108 and a lip 106. The voided channels 204, 206 may be manufactured into the base 108 or removed after manufacture. The voided channels 204, 206 provide surface and support for the pallet as well as a suitable surface for forklift usage. The cross sectional view of the pallet 100 shows a first plane 208 corresponding to the surface of the pallet where the lip 106 meets the base 108 and within which the corners 114A-D of the upper surface 110 reside, i.e., where the inward sloping surfaces 102A, 102B, 102C, 102D meet the lip 106 at the first plane 208 along the perimeter 112 of the pallet 100 such that the inward sloping portions 102A-D reside on a first side of the first plane 208 and the lip 106 resides on a second opposite side of the plane 208. A second plane 210 corresponds to the plane within which the planar portion 104 resides. The first plane 208 and the second plane 210 can be spaced away from each other and can extend parallel to each other.

Each of the inward sloped portions 102A-D reside in separate and distinct planes that intersect the first plane 208 and the second plane 210. For example, as shown in FIG. 2A, the inward sloped portion 102A resides in a plane 214A that intersects the first and second planes 208 and 210 and the inward sloped portion 102C resides in a plane 214C. The inward sloped portion 102A can extend downwardly from the corner 114A along the plane 214A at an acute angle A, i.e., the interior angle formed between the planes 208 and 214A. The inward sloped portion 102C can extend downwardly from the corner 114C along the plane 214C at an acute angle C, i.e., the interior angle formed between the planes 208 and 214C. In exemplary embodiments, the acute angles A and C can be between approximately one and approximately five degrees. In some embodiments, the acute angles A and C can be equal to each other, and in some embodiments, the acute angles A and C can be different from each other.

Figure 2B:
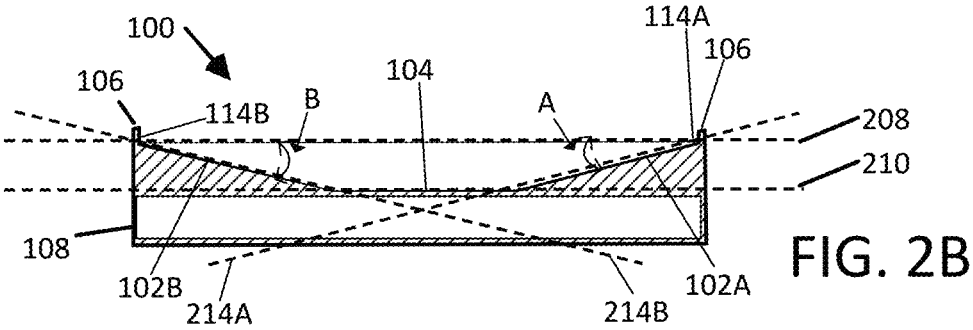
FIG. 2B is a cross sectional side view of a concave pallet according to embodiments of the present disclosure.
Figure 2C:
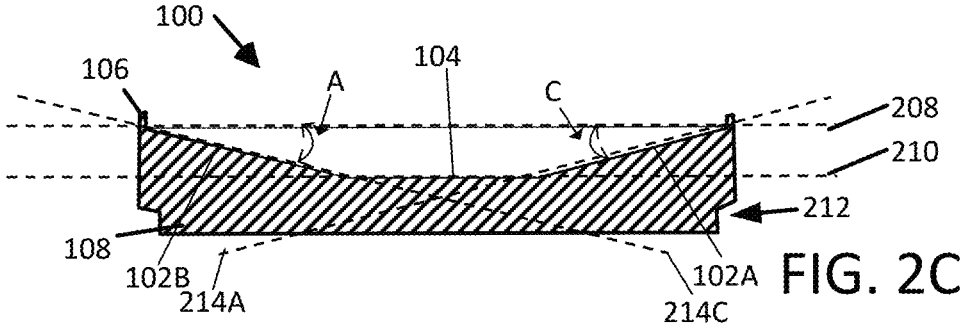
FIG. 2C is a cross sectional side view of a concave pallet according to embodiments of the present disclosure.

FIG. 2B is a cross sectional view of an embodiment of the pallet 100 along the line 2-2 shown in FIG. 1A. The cross section shown in FIG. 2B illustrates the inwardly sloped portions 102A and 102B, as well as voided channel 204 through the base 108 and the lip 106. As demonstrated by cross section shown in FIG. 2B, the voided channel 204 (and voided channel 206) can span a length of the pallet 100.

As shown in FIG. 2B, the inward sloped portion 102B resides in the plane 214B that intersects the first and second planes 208 and 210. The inward sloped portion 102B can extend downwardly from the corner 114B along the plane 214B at the acute angle B, i.e., the interior angle formed between the planes 208 and 214B. In exemplary embodiments, the acute angle B can be between approximately one and approximately five degrees. In some embodiments, the acute angles A, B, and C can be equal to each other, and in some embodiments, the acute angles A, B, and C can be different from each other.

FIG. 2C is a cross sectional diagram illustrating an embodiment of the pallet 100 along a line 3-3 in FIG. 1 except that in the present embodiment, the base 108 of the pallet 100 includes a notch 212 at the base 108 to allow the stacking of a pallet 100. The notch 212 interlocks with the lip 106 of the pallet 100 to provide stability in stacking. Inward sloping planes 214A, 214C correspond to two of the planes corresponding to the inward sloping portions 102A and 102C, of the pallet 100, respectively.

As shown in FIG. 2C, the inward sloped portion 102D resides in the plane 214D that intersects the first and second planes 208 and 210. The inward sloped portion 102D can extend downwardly from the corner 114D along the plane 214D at the acute angle D, i.e., the interior angle formed between the planes 208 and 214D. In exemplary embodiments, the acute angle D can be between approximately one and approximately five degrees. In some embodiments, the acute angles A, B, C, and D can be equal to each other, and in some embodiments, the acute angles A, B, C, D can be different from each other.

Figure 3A:
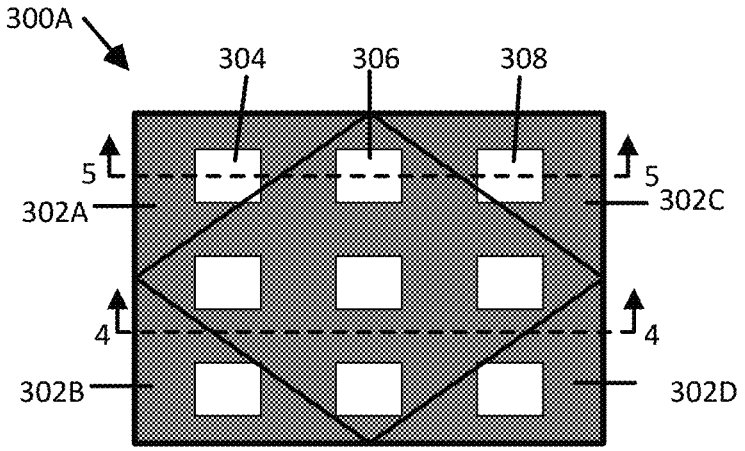
FIG. 3A is a top-view of a concave pallet according to embodiments of the present disclosure.

FIG. 3A is a top-view diagram illustrating a pallet 300A according to one embodiment. FIG. 3A presents a pallet 300A with voided cavities 304, 306, 308. The pallet 300A maintains features present in FIG. 1A including inward sloping surfaces 302A, 302B, 302C, 302D. The voided cavities 304, 306, 308 may allow for decreased weight during usage and decreased materials to be consumed during manufacturing. In one embodiment, the voided cavities 304, 306, 308 may be symmetrically spaced through out the pallet in order to provide better overall balance for the pallet.

Figure 3B:
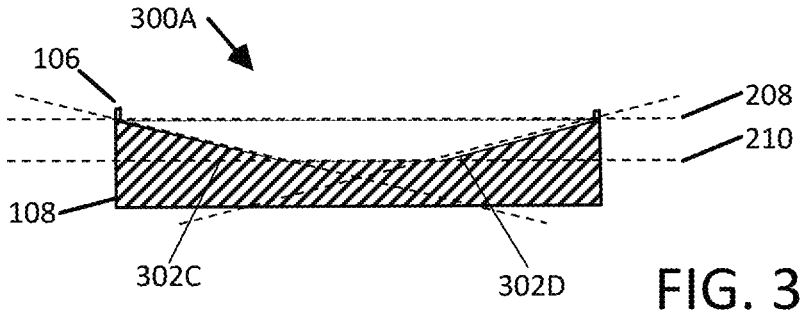
FIG. 3B is a cross sectional side view of an exemplary concave pallet according to embodiments of the present disclosure.

FIG. 3B is a cross sectional view of an embodiment of the pallet 300A along the line 4-4 shown in FIG. 3A according to one embodiment. The cross section illustrates the inward sloped surfaces 302A and 302A, as well as the base 108 and a lip 106. As shown in FIG. 3B, the base 308 can include a non-voided portion.

Figure 3C:
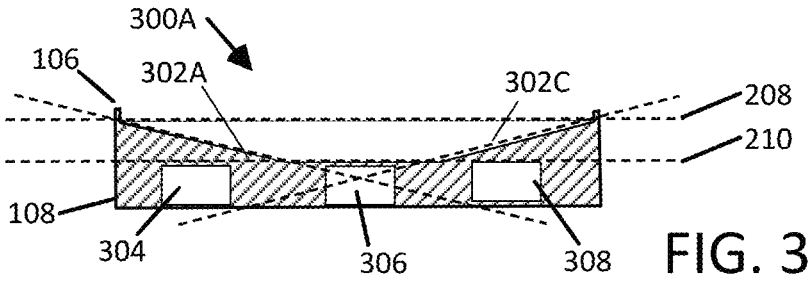
FIG. 3C is a cross sectional side view of an exemplary concave pallet according to embodiments of the present disclosure.

FIG. 3C is a cross sectional view of an embodiment of the pallet 300A along the line 5-5 according to one embodiment. The cross section illustrates the inward sloped surface 302 B and 302D, as well as voided cavities 304, 306, 308 through the base 108, and a lip 106. The voided cavities 304, 306, 308 may be manufactured into the pallet or removed after manufacture. The voided and non-voided structure of the pallet 300A provides strength to the pallet to properly support packages placed on the upper surface 304 while reducing the amount of material required to form the pallet 300A and reducing a weight of the pallet 300A because the voided cavities 304, 306, 308 allow for less material to be utilized in the construction of the pallet, and thereby decrease the weight and cost of the pallet 300A. The pallet 300A evenly and uniformly allocates the voided cavities 304, 306, 308 throughout the pallet to enhance the balance and stability of the pallet 300A.

Figure 4:
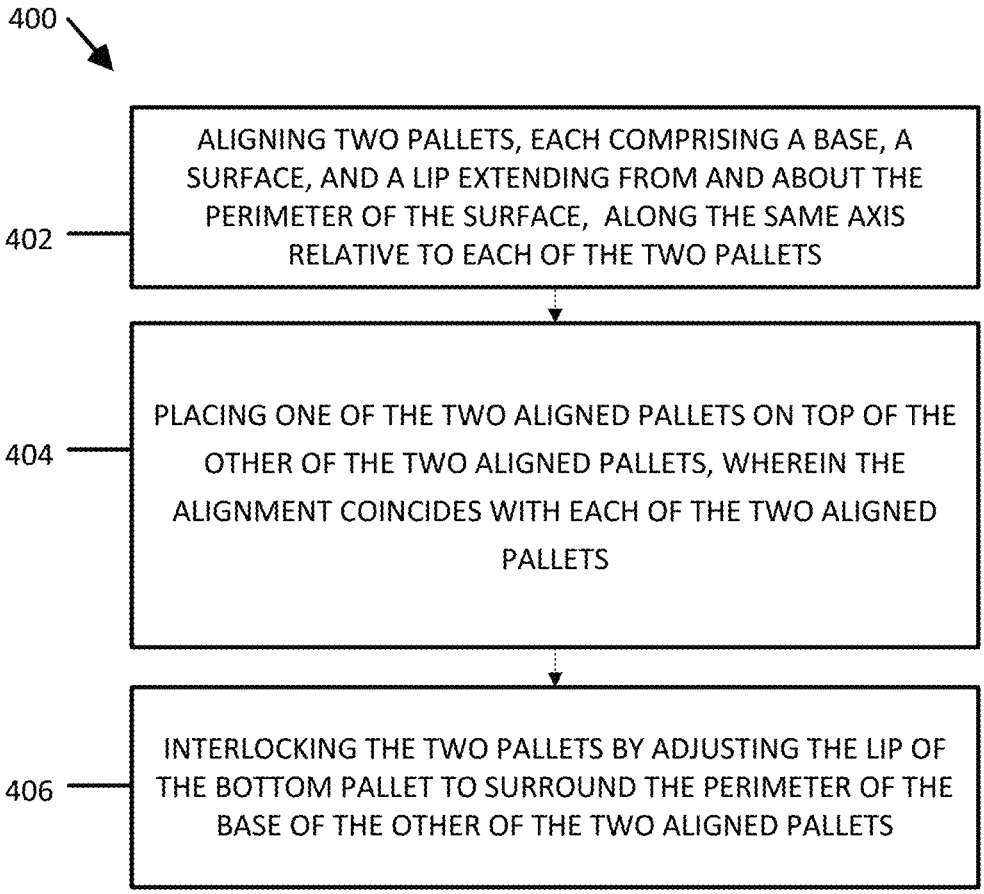
FIG. 4 is a flowchart illustrating a process for stacking a concave pallet according to embodiments of the present disclosure.

FIG. 4 is a flowchart 400 illustrating a process for stacking embodiments of the pallets according the present disclosure.

At step 402, two pallets are aligned, each comprising a base, a surface and a lip extending from and about the perimeter of the surface, along the same axis relative to each of the two pallets. The two pallets can be turned so that they are aligned in the same axis, where the surface and the base of the first pallet are in parallel planes from one another. Likewise the second pallet is turned and aligned where the surface and base of the second pallet are in parallel planes to that of the surface and base of the first pallet. In the event the pallets are not symmetrical in all directions, the two pallets may be rotated so that their geometries coincide in the same corresponding planes.

In step 404, one of the two aligned pallets is placed on top of the other of the two aligned pallets, wherein the alignment coincides with each of the two aligned pallets. The base of the first or second pallet is placed adjacent and parallel to the surface of the other pallet, where the base and the surface may contact.

In step 406, the two pallets are interlocked by adjusting the lip of the top pallet to surround the perimeter of the base of the other of the two aligned pallets. In the embodiment where the lip protrudes, the base can fit completely inside the lip, where the base of one pallet comes into contact with the surface of the other. In the embodiment where the lip is notched, the base of one pallet comes into contact with the surface created by the notching. In the embodiment where the base is notched, the notched base comes into contact with the surface of the lip, where a portion of the base rests interior to the lip.

Figure 5:
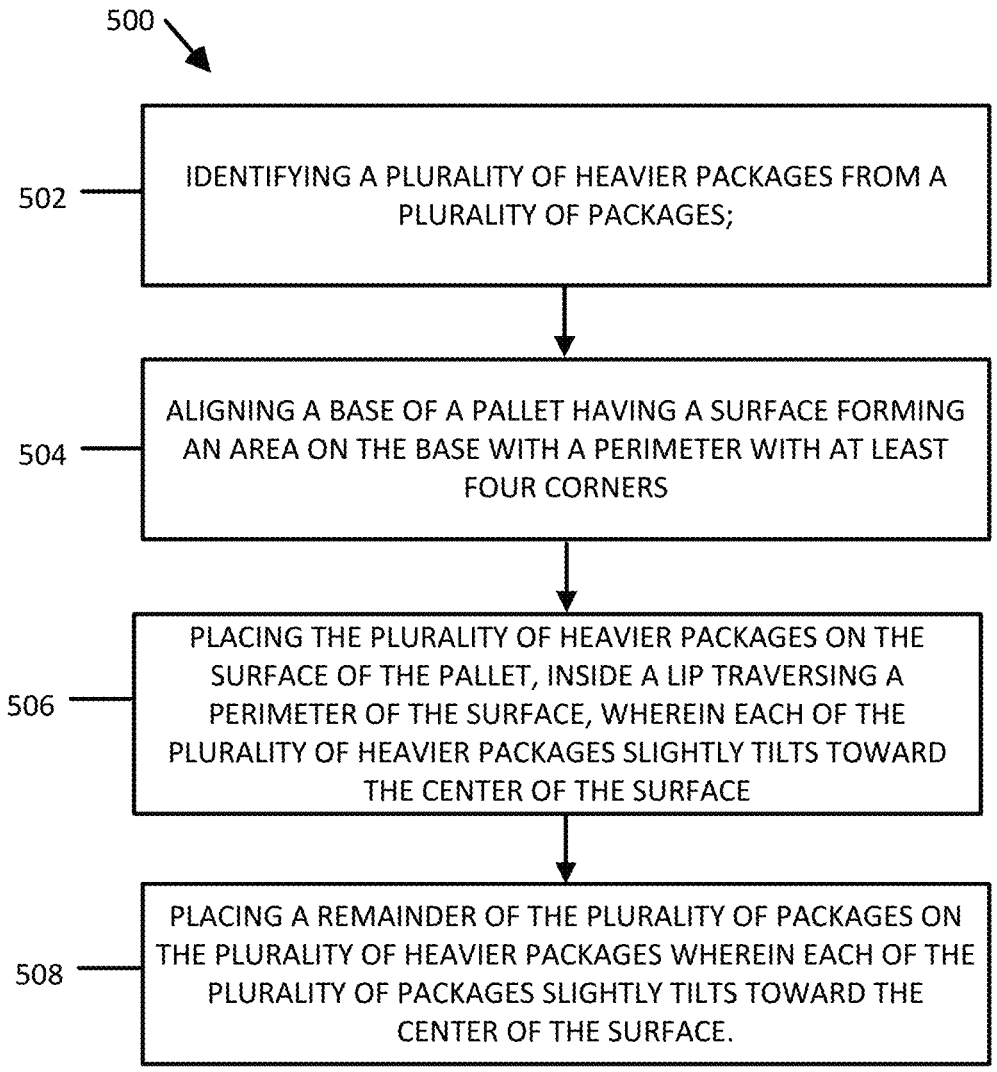
FIG. 5 is a flowchart illustrating a process for loading a pallet for supporting objects according to embodiments of the present disclosure.

FIG. 5 is a flowchart 500 illustrating a process for loading a pallet for supporting objects.

At step 502, a plurality of heavier packages is identified from a plurality of packages. Heavier packages to be loaded on the pallet may be determined based on characteristics in a bill of goods or invoice. In one embodiment, the bill of goods or invoice may be sorted by weight, indicating the heaviest packages to be placed on the pallet first. Lighter packages may be listed later in the invoice. Alternatively, heavier items may be located at different locations in a facility, and the bill of goods or invoice may be arranged to make those items closer in proximity to one another, so that the picking of the packages is more efficient in gather heavier items first.

At step 504, a base of a pallet is aligned where the surface is accessible. The base of the pallet can be aligned so that the heavier packages may be placed on the surface of the pallet. The alignment may include turning the pallet to a similar angle of the edges of the package so that package placement is more appropriate given the geometries of the pallet surface.

At step 506, the plurality of heavier packages are placed on the surface of the pallet, inside a lip traversing the perimeter of the surface, wherein each of the plurality of heavier packages slightly tilts toward the center of the pallet. The heavier packages can be placed in a balanced fashion, where the placement is proportional to the weight of the package. For example, the heaviest packages may be placed on opposite sides of the pallet to effectively keep the pallet balanced.

At step 508, the remainder of the plurality of packages are placed on the heavier packages wherein each of the plurality of packages slightly tilts toward the center of the surface. The remainder of the packages are placed on the heavier packages. As the heavier packages are supported at an inwardly sloping angle, due to the surface of the pallet, the remainder of the packages can slightly tilt inward and downward to the center of the pallet build. The remainder of the packages come to support each other at the center where the inward pressure holds the packages centrally on the pallet.

In describing exemplary embodiments, specific terminology is used for the sake of clarity. For purposes of description, each specific term is intended to at least include all technical and functional equivalents that operate in a similar manner to accomplish a similar purpose. Additionally, in some instances where a particular exemplary embodiment includes a multiple system elements, device components or method steps, those elements, components or steps may be replaced with a single element, component or step. Likewise, a single element, component or step may be replaced with multiple elements, components or steps that serve the same purpose. Moreover, while exemplary embodiments have been shown and described with references to particular embodiments thereof, those of ordinary skill in the art will understand that various substitutions and alterations in form and detail may be made therein without departing from the scope of the present disclosure. Further still, other aspects, functions and advantages are also within the scope of the present disclosure.

Exemplary flowcharts are provided herein for illustrative purposes and are non-limiting examples of methods. One of ordinary skill in the art will recognize that exemplary methods may include more or fewer steps than those illustrated in the exemplary flowcharts, and that the steps in the exemplary flowcharts may be performed in a different order than the order shown in the illustrative flowcharts.

The invention claimed is:

1. A pallet for supporting objects comprising:

a base including a structure configured to receive at least one blade of a forklift or pallet jack;

a surface forming an area on the base having a perimeter with at least four corners, each of the at least four corners residing in a first plane, the surface including:

a planar portion disposed inward and spaced away from the perimeter, the planar portion residing on a second plane extending parallel to and being offset to a first side of the first plane;

a plurality of sloped portions originating at the at least four corners of the perimeter and extending on the first side of the first plane to the planar portion at an acute angle relative to the first plane to define a gradient between the perimeter and the surface, wherein each of the sloped portions coincide with a separate and distinct independent plane that intersects the first and second planes; and a lip extending from and about the perimeter of the surface on a second side of the first plane.

2. The pallet of claim 1, wherein the gradient remains nonzero along the perimeter to a midpoint of two adjacent sides from each of the at least four corners of the surface.

3. The pallet of claim 1, wherein the base of the pallet is notched traversing the exterior perimeter of the base.

4. The pallet of claim 1, wherein a pair of parallel hollow channels traverse the base.

5. The pallet of claim 1, wherein strike plates attach to an exterior of each of the corners of the base.

6. The pallet of claim 1, wherein the base, the surface, and the lip are constructed of one selected from the group of polymers, woods, and metals.

7. The pallet of claim 1, wherein the base comprises a plurality of cavities arranged in a symmetrical pattern.

8. The pallet of claim 1, wherein the gradient becomes zero at a radius originating at the center of the surface.

9. The pallet of claim 1, wherein the gradient is linear.

10. A method for storing a pallet for stabilizing contents comprising:

aligning two pallets, each comprising a base, a surface, and a lip extending from and about the perimeter of the surface, along the same axis relative to each of the two pallets;

placing one of the two aligned pallets on top of the other of the two aligned pallets, wherein the alignment coincides with each of the two aligned pallets; and interlocking the two pallets by adjusting the lip of the bottom pallet to surround the perimeter of the base of the other of the two aligned pallets, wherein the surface comprises an area on the base having a perimeter with at least four corners, each of the at least four corners residing in a common plane, the surface including:

a planar portion disposed inward and spaced away from the perimeter, the planar portion extending parallel to and being offset to a first side of the common plane;

a plurality of sloped portions originating at the at least four corners of the perimeter and extending to the planar portion at an acute angle relative to the common plane to define a gradient between the perimeter and the surface.

11. The method of claim 10, wherein the base of each of the two pallets is notched along the exterior perimeter of the base.

12. The method of claim 10 wherein a pair of parallel hollow channels traverse the base.

13. A method for loading a pallet for supporting objects comprising:

identifying a plurality of heavier packages from a plurality of packages;

aligning a base of a pallet having a surface forming an area on the base with a perimeter with at least four corners, each of the at least four corners residing in a common plane, the surface including:

a planar portion disposed inward and spaced away from the perimeter, the planar portion extending parallel to and being offset to a first side of the common plane;

a plurality of sloped portions originating at the at least four corners of the perimeter and extending to the planar portion at an acute angle relative to the common plane to define a gradient between the perimeter and the surface;

placing the plurality of heavier packages on the surface of the pallet, inside a lip traversing a perimeter of the surface, wherein each of the plurality of heavier packages slightly tilts toward the center of the surface;

placing a remainder of the plurality of packages on the plurality of heavier packages wherein each of the plurality of packages slightly tilts toward the center of the surface.

14. The method of claim 13, wherein the surface follows a gradient that becomes zero at a point on a line between a center of the surface and equidistant from each corner of the surface.

15. The method of claim 14, wherein the gradient is linear.

16. The method of claim 13, wherein the surface follows a gradient becoming zero at a radius originating at a center of the surface.

17. The method of claim 13, wherein a pair of parallel hollow channels traverse the base.

* * * * *